United States Patent [19]

Foster et al.

[11] 4,326,145

[45] Apr. 20, 1982

[54] COMPRESSION RELIEF ADAPTER

[75] Inventors: Leslie W. Foster, Wayzata; Henry B. Tillotson, Minneapolis, both of Minn.

[73] Assignee: The Toro Company, Minneapolis, Minn.

[21] Appl. No.: 116,269

[22] Filed: Jan. 28, 1980

[51] Int. Cl.[3] ..... F02N 17/08

[52] U.S. Cl. ..... 313/120; 123/182

[58] Field of Search ..... 313/120, 119, 143; 123/169 V, 182, 151, 152

[56] References Cited

U.S. PATENT DOCUMENTS

| | | | |
|---|---|---|---|
| 1,925,086 | 9/1933 | Snyder | 123/182 X |
| 2,370,599 | 2/1945 | Whittaker | 313/120 |
| 2,534,860 | 12/1950 | Fisher | 123/182 X |
| 3,079,453 | 2/1963 | Clark | 123/169 V |
| 3,480,853 | 11/1969 | Cloninger | 313/140 X |
| 3,919,991 | 11/1975 | Neschke et al. | 123/182 |
| 4,202,307 | 5/1980 | Imamura | 123/169 V |

*Primary Examiner*—Eugene R. La Roche
*Attorney, Agent, or Firm*—James W. Miller

[57] ABSTRACT

An improved spark plug and a compression relief adapter are described which are designed to permit a portion of the gases in the cylinder of an internal combustion engine to vent during the starting operation so as to make it easier to manually start the engine.

6 Claims, 4 Drawing Figures

COMPRESSION RELIEF ADAPTER

BACKGROUND OF THE INVENTION

This invention relates to an improved spark plug and, more particularly, to mechanisms for relieving a portion of the normal compression forces during the starting operation of an internal combustion engine.

Because of the normal compression forces obtained in conventional internal combustion engines it is often difficult for some persons to manually start such engines (e.g. on conventional lawn mowers, snow blowers, etc.) using a normal recoil starter. Although pressure relief or bleed valves are commercially available which are designed to vent a portion of the gases from the cylinder during the starting operation of the engine, it is necessary to drill a separate hole or aperture in the cylinder head in order to accommodate the pressure relief or bleed valve. This technique, of course, does not lend itself to practical retrofitting on engines already in the hands of consumers.

The present invention provides means for relieving the normal compression in an internal combustion engine so that the starting operation is much easier, for example, for children and elderly persons. The apparatus of the invention is designed such that any conventional engine may be easily and readily retrofitted with such pressure relief means.

SUMMARY OF THE INVENTION

In one embodiment of the invention there is provided a spark plug of the type having a lower portion adapted to be threaded into the cylinder head of an internal combustion engine, wherein said lower portion surrounds an electrode encased in an insulator, wherein the improvement comprises a passageway in said lower portion which is adapted to communicate with the combustion cylinder of said engine in a manner such that gases in said cylinder may exit said cylinder through said passageway.

In another embodiment of the invention there is provided an article comprising an inlet portion and an exit portion, said inlet portion having an opening therethrough which is adapted to permit the lower threaded portion of a spark plug to extend therethrough, said exit portion being laterally offset from said inlet portion and being adapted to receive a bleed valve therein, wherein said exit portion communicates with said inlet portion by means of a passageway.

DETAILED DESCRIPTION OF THE INVENTION

The invention is described in more detail hereinafter with reference to the accompanying drawings wherein like reference characters refer to the same parts throughout the several views and in which.

Figure 1:
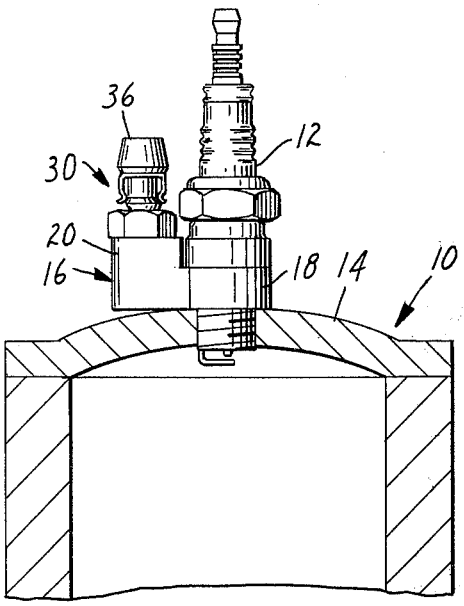
FIG. 1 shows apparatus of the invention installed on an internal combustion engine.
Figure 2:
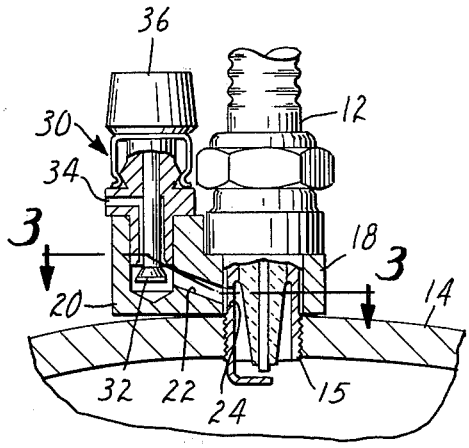
FIG. 2 is a cross-sectional view of the apparatus of the invention shown in FIG. 1.
Figure 3:
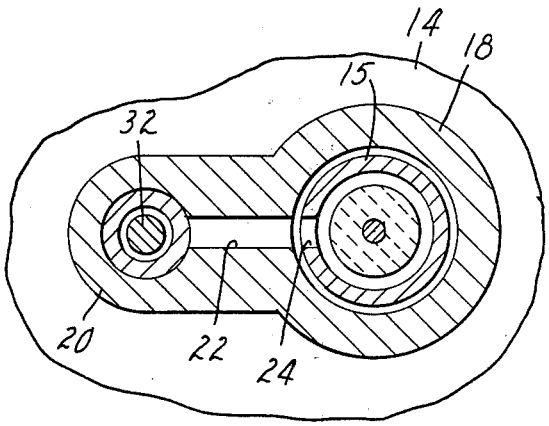
FIG. 3 is a sectional view taken along line 3—3 in FIG. 2.

In FIGS. 1, 2 and 3 there is shown the upper portion of cylinder 10 of an internal combustion engine in which spark plug 12 is threadably received in head 14. Compression relief adapter 16 comprises a base or inlet portion 18, through which the lower end 15 of spark plug 12 passes, and an exit portion 20 which is laterally offset from the inlet portion 18. Pressure relief or bleed valve 30 is threadably received in exit portion 20. Inlet portion 18 communicates with exit portion 20 by means of passageway 22.

Figure 4:
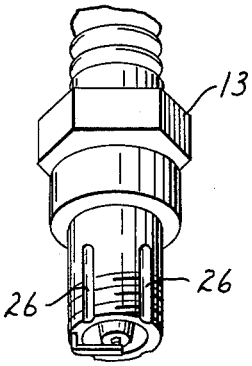
FIG. 4 shows another embodiment of an improved spark plug useful in the present invention.

The lower portion 15 of spark plug 12 preferably has an aperture or passageway therein which enables a portion of the gases in the cylinder 10 to exit the cylinder. For example, there may be an aperture 24 extending transversely through the lower portion of the plug. Alternatively there may be one or more elongated grooves or passageways 26 extending longitudinally of the plug 13 as shown in FIG. 4. Another alternative involves forming a passageway in the head 14 which communicates between the cylinder 10 and the inlet portion 18. This latter alternative is less preferred, however, because it requires slight modification of the engine in the consumer's hands and therefore does not readily permit retrofitting.

The gases which exit the cylinder 10 enter the inlet portion 18 and are directed through passageway 22 to exit portion 20. Bleed valve 30 is threadably received in exit portion 20 and it is moveable between an open position (where plunger 32 is pushed downward to permit gases to exit through aperture 34 in the side of the valve) and a closed position (where plunger 32 is pushed upward to block the flow of gases through the valve). Bleed valves of this type are conventional; a commonly used valve is Model No. 11245 which is commercially available from Dapco Industries.

When it is desired to start the engine the plunger 32 of bleed valve 30 is pushed downward by means of button 36 so as to establish an open path from cylinder 10 to the atmosphere. During the starting of the engine a portion of the gases from the cylinder are thus able to exit to the atmosphere so that the compression forces are thereby reduced. This enables children and elderly persons to more easily start the engine. As the engine starts the sharp increase in compression due to the expansion of combustion gases pushes the plunger 32 of bleed valve 30 upward to its closed position.

The manner in which the present invention relieves a portion of the compression forces through the spark plug or through the spark plug hole in the engine head also provides another significant advantage in that it assures that the airfuel mixture is brought into intimate contact with the spark plug during the starting operation. This increases the likelihood that the engine will start promptly. This result is contrasted with other techniques for relieving compression forces wherein the bleed valve is placed in a specially made aperture elsewhere in the head (i.e. away from the spark plug).

What is claimed is:

1. A compression relief adapter for relieving compression in a combustion chamber of an internal combustion engine, which adapter is suited for use with a spark plug having a threaded lower end and an upper end including a tightening nut and an enlarged portion below the nut, which adapter is also suitable for use with a pressure relief bleed valve having a threaded lower end and a selectively openable relief passageway therein, which comprises:

a one-piece body member that includes an inlet portion and an exit portion, wherein the inlet portion includes an opening extending therethrough sized to receive the lower end of the spark plug, wherein the inlet portion also includes a seat against which the enlarged portion of the spark plug bears when the threaded lower end of the spark plug is threadedly received in the combustion chamber to clamp the body member to the engine, wherein the exit portion is offset to one side of the inlet portion and includes an elongated bore therein, wherein the bore is threaded to receive the lower end of the bleed valve to couple the bleed valve thereto such that the bleed valve is operable in the threaded bore of the exit portion to communicate the threaded bore to atmosphere when the relief passageway of the bleed valve is opened, and further including a connecting passageway for connecting the bore in the exit portion to the combustion chamber of the engine.

2. A compression relief adapter as recited in claim 1, wherein the opening in the inlet portion and the bore in the exit portion are substantially parallel to one another to decrease the size of the body member.

3. A compression relief adapter as recited in claim 1, wherein the opening in the inlet portion communicates with the combustion chamber through an aperture in the spark plug, and wherein the connecting passageway connects the opening in the inlet portion to the bore in the exit portion.

4. A compression relief adapter as recited in claim 1, wherein the inlet and exit portions are both cylindrical in shape, and wherein the opening in the inlet portion extends through the entire length of the inlet portion such that the seat thereof is a top face of the inlet portion.

5. A compression relief adapter as recited in claim 4, wherein the bleed valve also includes a tightening nut thereon which is used to tighten the bleed valve in the threaded bore of the exit portion, wherein the cylindrical of the exit portion has a top face against which the tightening nut on the bleed valve seats to hold the bleed valve therein, and wherein the top faces of both the inlet and exit portions of the body member are located below the tightening nuts on the bleed valve and the spark plug so that both the bleed valve and the spark plug can be tightened from above the adapter.

6. A compression relief adapter as recited in claim 1, further including a bleed valve threadedly secured in in the bore of the exit portion.

* * * * *